US009434061B2

(12) United States Patent
Lee et al.

(10) Patent No.: US 9,434,061 B2
(45) Date of Patent: Sep. 6, 2016

(54) RESTART PROTECTION DEVICE AND METHOD THEREOF

(71) Applicants: SOLTEAM ELECTRONICS (DONG GUAN) CO.,LTD., DongGuan/GunagDong (CN); SOLTEAM ELECTRONICS (SU ZHOU) CO.,LTD., Wu Jiang/Jiangsu (CN); Solteam Electronics Co., Ltd., Taoyuan (TW)

(72) Inventors: Chao-Yi Lee, Taoyuan (TW); Chang-Nan Chen, Taoyuan (TW); Chen-Hong Huang, Taoyuan (TW); Ying-Sung Ho, Taoyuan (TW)

(73) Assignees: SOLTEAM ELECTRONICS (DONG GUAN) CO.,LTD. (CN); SOLTEAM ELECTRONICS (SU ZHOU) CO.,LTD. (CN); SOLTEAM ELECTRONICS CO., LTD. (TW)

( * ) Notice: Subject to any disclaimer, the term of this patent is extended or adjusted under 35 U.S.C. 154(b) by 516 days.

(21) Appl. No.: 14/074,841

(22) Filed: Nov. 8, 2013

(65) Prior Publication Data

US 2015/0129267 A1 May 14, 2015

(51) Int. Cl.
*B25F 5/00* (2006.01)
*H01H 35/02* (2006.01)

(52) U.S. Cl.
CPC ..... *B25F 5/00* (2013.01)

(58) Field of Classification Search
CPC ..... H01H 35/02
USPC ..... 307/328
See application file for complete search history.

(56) References Cited

U.S. PATENT DOCUMENTS

2013/0026857 A1* 1/2013 Schmid ..... H02J 7/0045 307/328

* cited by examiner

*Primary Examiner* — Robert Deberadinis

(57) ABSTRACT

The present invention relates to a restart protection device and a method thereof, wherein the restart protection device is installed in an electric device, and comprises a switch module and a restart protecting module. The restart protecting module is connected between the switch module and a motor of the electric device, used for preventing the current outputted by an external electrical power from directly flowing into the motor when the electric device is restarted. To start the electric device, the user must follow the steps of the restart protection method, such that the unexpected accidents resulted from the sudden restart of the electric device can be effectively prevented.

9 Claims, 10 Drawing Sheets

RESTART PROTECTION DEVICE AND METHOD THEREOF

BACKGROUND OF THE INVENTION

1. Field of the Invention

The present invention relates to a protection device, and more particularly to a restart protection device and a method thereof.

2. Description of the Prior Art

Recently, with the development of large home supply and appliance mall malls, people would carry out some home minor works by DIY in order to saving the expense for hiring a professional engineer, for example, house repairs, furniture assembly, air conditioner installation, etc. To carry out the home minor works by DIY, power tool (or electric tool) is one of the important and necessary hand tools.

Please refer to FIG. 1, which illustrates a stereo view of a conventional power tool. Generally, the power of the power tool 1' does come from a build-in battery; However, for the power tool 1' having high output power, as shown in FIG. 1, it is connected to an external electrical power through an electrical cable 13' for obtaining enough electrical power. For this reason, when a user want to use the power tool 1' having high output power, the user needs to connect the electrical cable 13' of the power tool 1' to the external electrical power 2' in advance; and then, the user is able to hold the handle portion 11' of the power tool 1' and align the output portion 15' of the power tool 1' to an object, so as to complete the home minor work by pressing the trigger switch 12' of the power tool 1'.

Continuously referring to FIG. 1, and please simultaneously refer to FIG. 2, there is shown a schematic power-outputting diagram of the conventional power tool 1'. As shown in FIG. 2, when the user presses the trigger switch 12', the power energy supplied by the electrical power 2' can be coupled to the motor 14 disposed in the power tool 1' through the trigger switch 12', such that the motor 14, is able to operate and provide an output power. However, there are un-normal operation situation when the power tool 1' is operated by the user:

Un-Normal Operation Situation (1)

For the users having bad habits for operating the power tool 1', they often turn off the power tool 1' by directly unplugging the electrical cable 13' from the electrical power 2', without switching off the trigger switch 12' in advance. Therefore, when the user connects the electrical cable 13' of the power tool 1' to the external electrical power 2', the motor 14' of the power tool 1' would immediately operate because the current outputted from electrical power 2' directly flows into the motor 14', such that the nails in the output portion 15' are shot out and then cause some unexpected accidents.

Un-Normal Operation Situation (2)

The electrical power 2' is suddenly tripped off and then be immediately recovered under the power tool 1' is used by the user; in the meantime, the motor 14' of the power tool 1' would immediately operate because the current outputted from electrical power 2' directly flows into the motor 14', such that the output portion 15' of the power tool 1' would rotate by a high speed and then cause some unexpected accidents.

Through above descriptions, it can find that, it is very important to dispose a restart protection device or module in the conventional power tool 1'. Accordingly, the inventor of the present application has made great efforts to make inventive research thereon and eventually provided a restart protection device and a method thereof, wherein the restart protection device can be installed in the power tool for preventing the accidents resulted from the above-mentioned un-normal operation situation of the power tool.

SUMMARY OF THE INVENTION

The primary objective of the present invention is to provide a restart protection device and a method thereof, wherein the restart protection device is installed in an electric device for preventing the accidents resulted from the following un-normal operations of the electric device;

Un-Normal Operation (1)

The user connects the electrical cable of the electric device to an external electrical power, without switching off the switch module of the electric device in advance; meanwhile, the current produced from restarting the electric device would be blocked off by the restart protection device installed in the electric device, therefore the current would not directly input into the motor of the electric device, such that the motor would not operate due to the sudden restart of the electric device.

Un-Normal Operation (2)

The electrical power is suddenly tripped off and then be immediately recovered under the electric device is used by the user; in the meantime, the current produced from restarting the electric device would be blocked off by the restart protection device installed in the electric device, therefore the current would not directly input into the motor of the electric device, such that the motor would not operate due to the sudden restart of the electric device.

Accordingly, to achieve the primary objective of the present invention, the inventor of the present invention provides a restart protection device, comprising:

a switch module, disposed in an electric device and coupled to an external electrical power, wherein the switch module has an electrical power terminal, a first output terminal and a second output terminal, and the electrical power terminal being connected to a line terminal of the electrical power; and a restart protecting module, disposed in the electric device and coupled to the switch module and a motor of the electric device, wherein the restart protecting module comprises: a relay coil, coupled to the first output terminal by one end thereof, and the other end of the relay coil is coupled to a first input terminal of the motor; a first relay switch, coupled to the second output terminal by one end thereof, and the other end of the first relay coil is coupled to a second input terminal of the motor; and a second relay switch, coupled to the line terminal and the electrical power terminal by one end thereof, and the other end of the second relay switch is coupled to the first output terminal and the relay coil. In which, the first input end of the motor is further coupled to a neutral terminal of the electrical power.

Moreover, to achieve the primary objective of the present invention, the inventor of the present invention provides a restart protection method, comprising the steps of:

(1) switching on the switch module, so as to make the electrical power terminal of the switch module electrically connect to the line terminal of the external electrical power; such that the current outputted by the line terminal of the external electrical power flows toward the first relay switch of the restart protecting module via the second output terminal of the switch module, and then be blocked off by the first relay switch;

(2) switching off the switch module, so as to make the electrical power terminal of the switch module electrically connect to the first output terminal; such that the current outputted by the line terminal of the electrical power flows into the relay coil of the restart protecting module via the electrical power terminal, and the first relay switch and the second relay switch being turned on by the induction of the relay coil; and (3) switching on the switch module, so as to make the electrical power terminal electrically connect to the second output terminal; such that the current outputted by the live terminal of the electrical power flows into the second input terminal of the motor in the electric device through the second output terminal of the switch module and the first relay switch of the restart protecting module, moreover the current outputted by the live terminal of the electrical power also flows into the first input terminal of the motor through the second relay switch and the relay coil of the restart protecting module, and then the motor is drive to operate by the current.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein:.

DETAILED DESCRIPTION OF THE PREFERRED EMBODIMENTS

To more clearly describe a restart protection device and a method thereof according to the present invention, embodiments of the present invention will be described in detail with reference to the attached drawings hereinafter.

Figure 1:
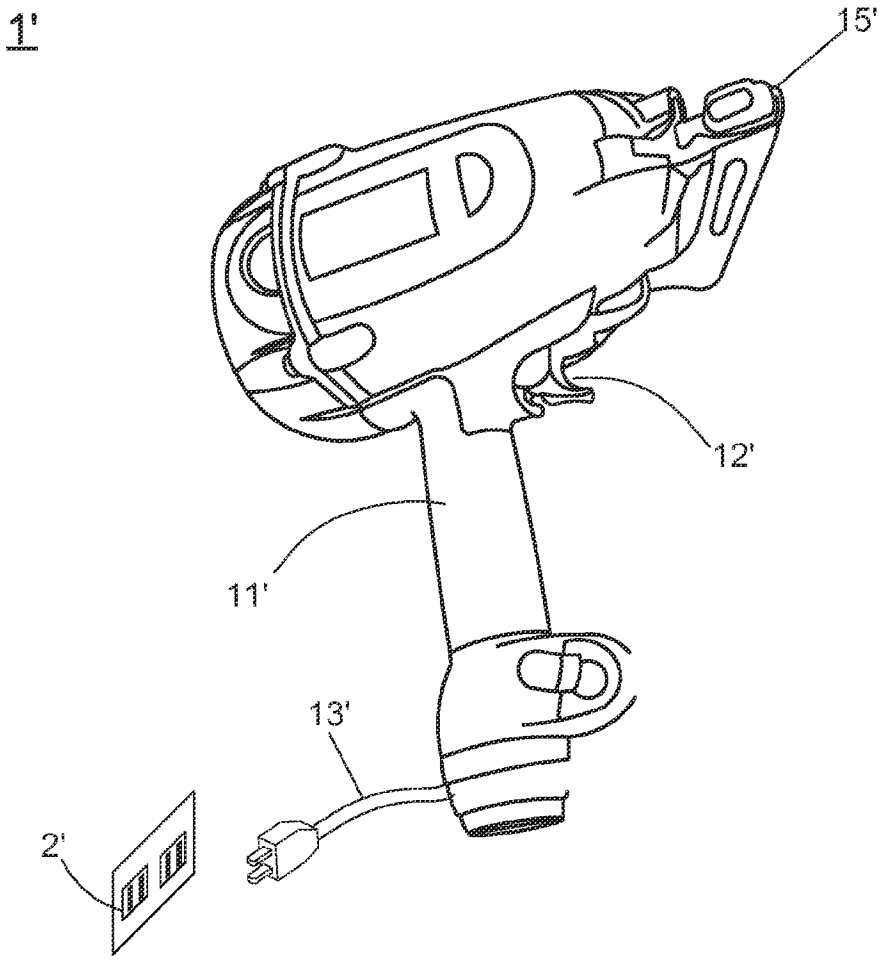
FIG. 1 (Prior Art)
FIG. 1 is a stereo view of a conventional power tool.
Figure 2:
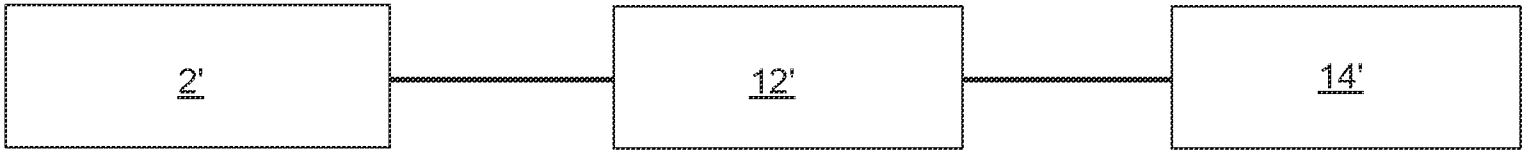
FIG. 2 (Prior Art)
FIG. 2 is a schematic power-outputting diagram of the conventional power tool.
Figure 3:
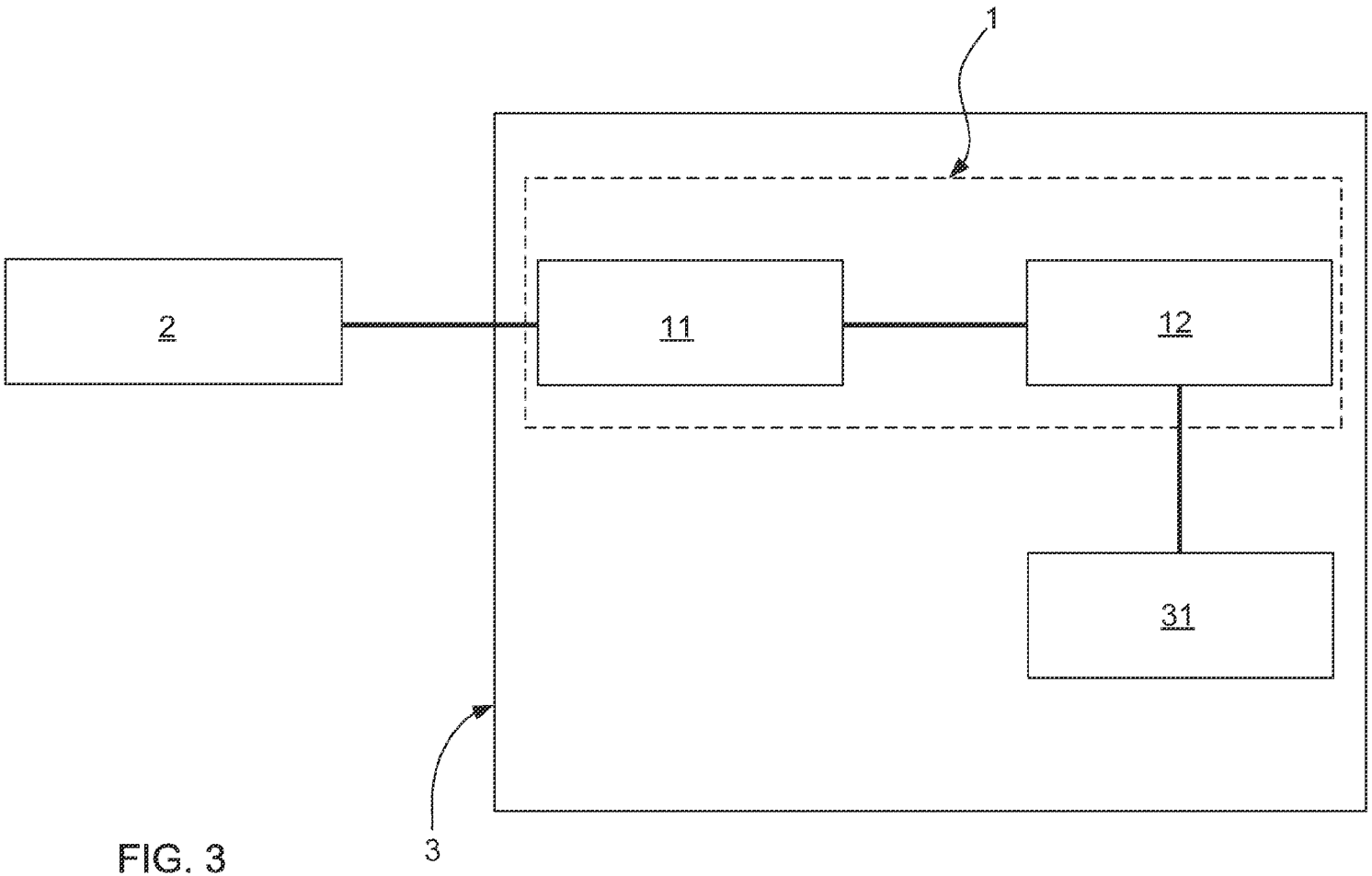
FIG. 3 is a block framework diagram of a restart protection device according to the present invention.
Figure 4:
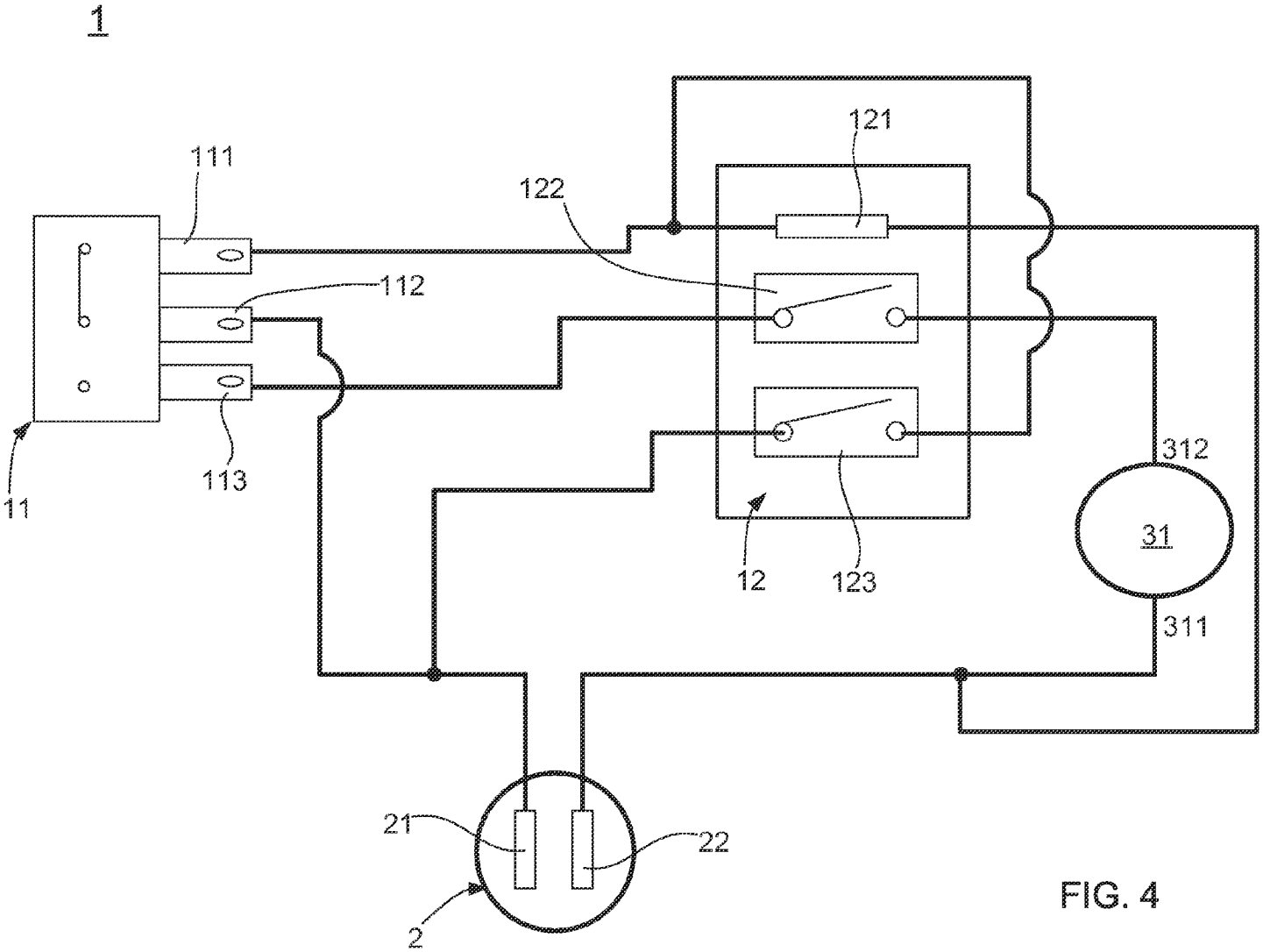
FIG. 4 is a circuit framework diagram of the restart protection device.

With reference to FIG. 3, which illustrates a block framework diagram of a restart protection device according to the present invention; moreover, please simultaneously refer to FIG. 4, there is shown a circuit framework diagram of the restart protection device. As shown in FIG. 3 and FIG. 4, the restart protection device 1 of the present invention is installed in an electric device 3, and consists of a switch module 11 and a restart protecting module 12, wherein the restart protecting module 12 is connected between the switch module 11 and a motor 31 of the electric device 3. Particularly, the switch module 11, such as rocker switch, slide switch or toggle switch, which includes three terminals of an electrical power terminal 112, a first output terminal 111 and a second output terminal 113, and the electrical power terminal 112 is coupled to a line terminal 21 of an external electrical power 2.

The restart protecting module 12 is also installed in the electric device 3 and coupled to the switch module 11 and the motor 31, and consists of a relay coil 121, a first relay switch 122 and a second relay switch 123. As shown in FIGS., one end of the relay coil 121 is coupled to the first output terminal 111, and the other end of the relay coil 121 is coupled to a first input terminal 311 (i.e., the neutral terminal of the motor 31) of the motor 31. In addition, one end of the first relay switch 122 is coupled to the second output terminal 113, and the other end of the first relay switch 122 is coupled to a second input terminal 312 (i.e., the live terminal of the motor 31) of the motor 31. Moreover, one end of the second relay switch 123 is coupled to the live terminal 21 of the electrical power 2 and the electrical power terminal 112 of the switch module 11, and the other end of the second relay switch 123 is coupled to the first output terminal 111 and the relay coil 121. Furthermore, the first input end 311 of the motor 31 is further coupled to a neutral terminal 21 of the electrical power 2.

Thus, by installing the restart protection device 1 shown as FIG. 4 in the electric device 3, the restart protection device 1 is able to effectively prevent the unexpected accidents resulted from the sudden restart of the electric device 3. Herein, it needs to further explain that, the aforesaid electric device 3 is especially indicated to the electric hand tools having high danger, such as metal cutting power tool (for example, electric saw), polish power tool (for example, electric grinder), assembly power tool, pneumatic gun, and hair dryer. To further explain the assembly power tool, which can be an electric drill, an electric wrench or an electric screw driver.

Figure 5:
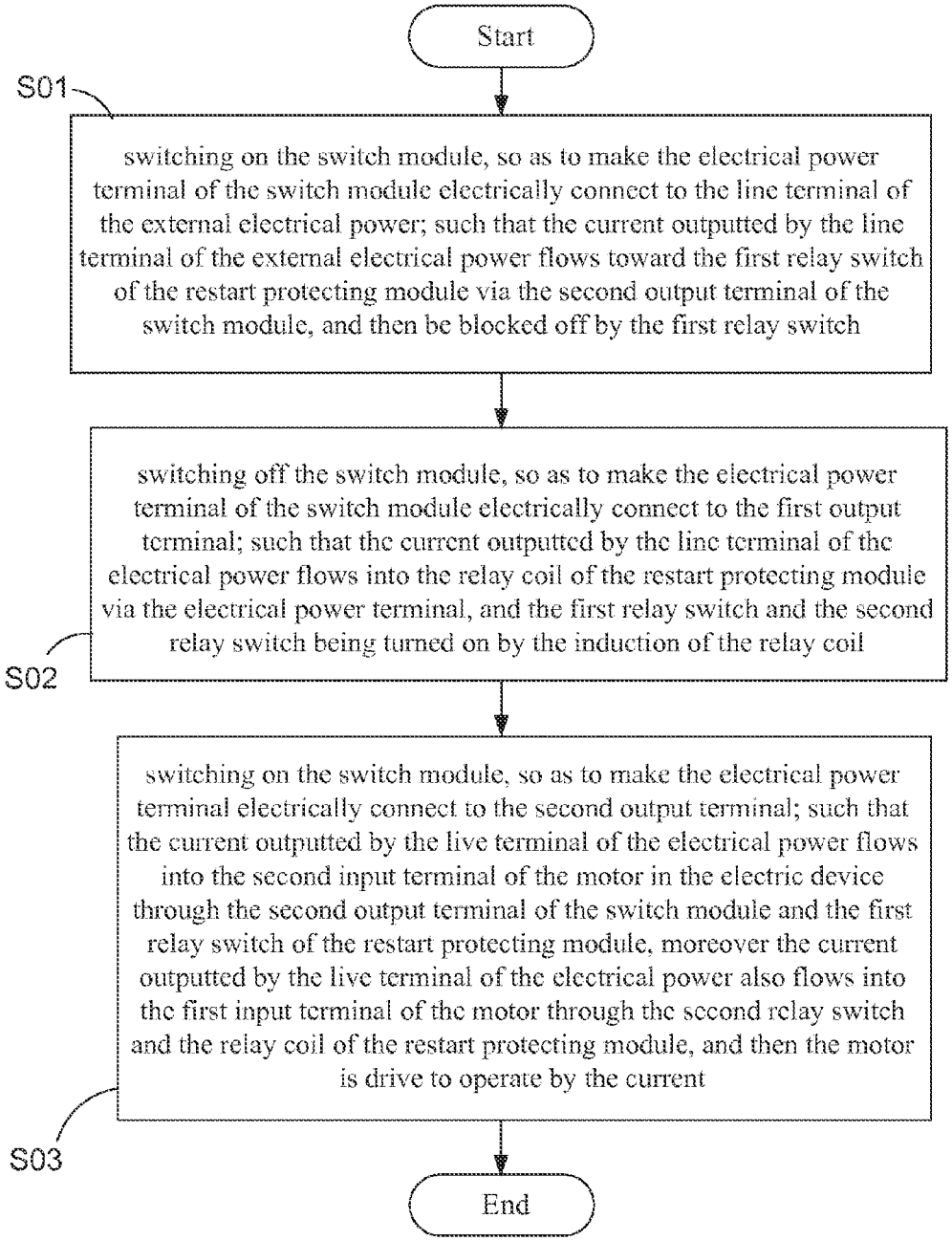
FIG. 5 is a flow chart of a restart protection method by using the restart protection device according to the present invention.
Figure 6A:
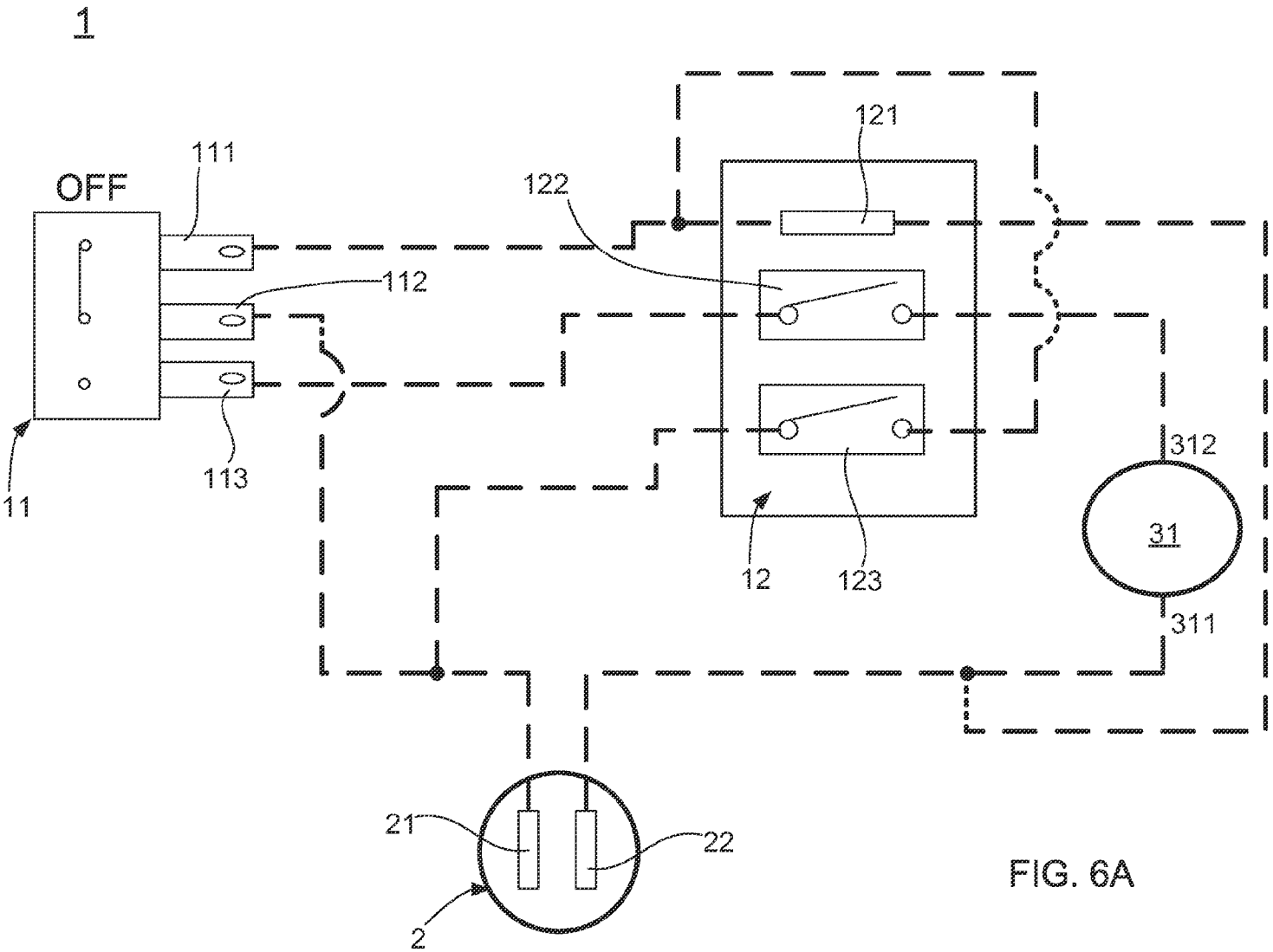
FIGS. 6A, 6B, 6C, and 6D are schematic circuit action diagrams of the restart protection device.
Figure 6B:
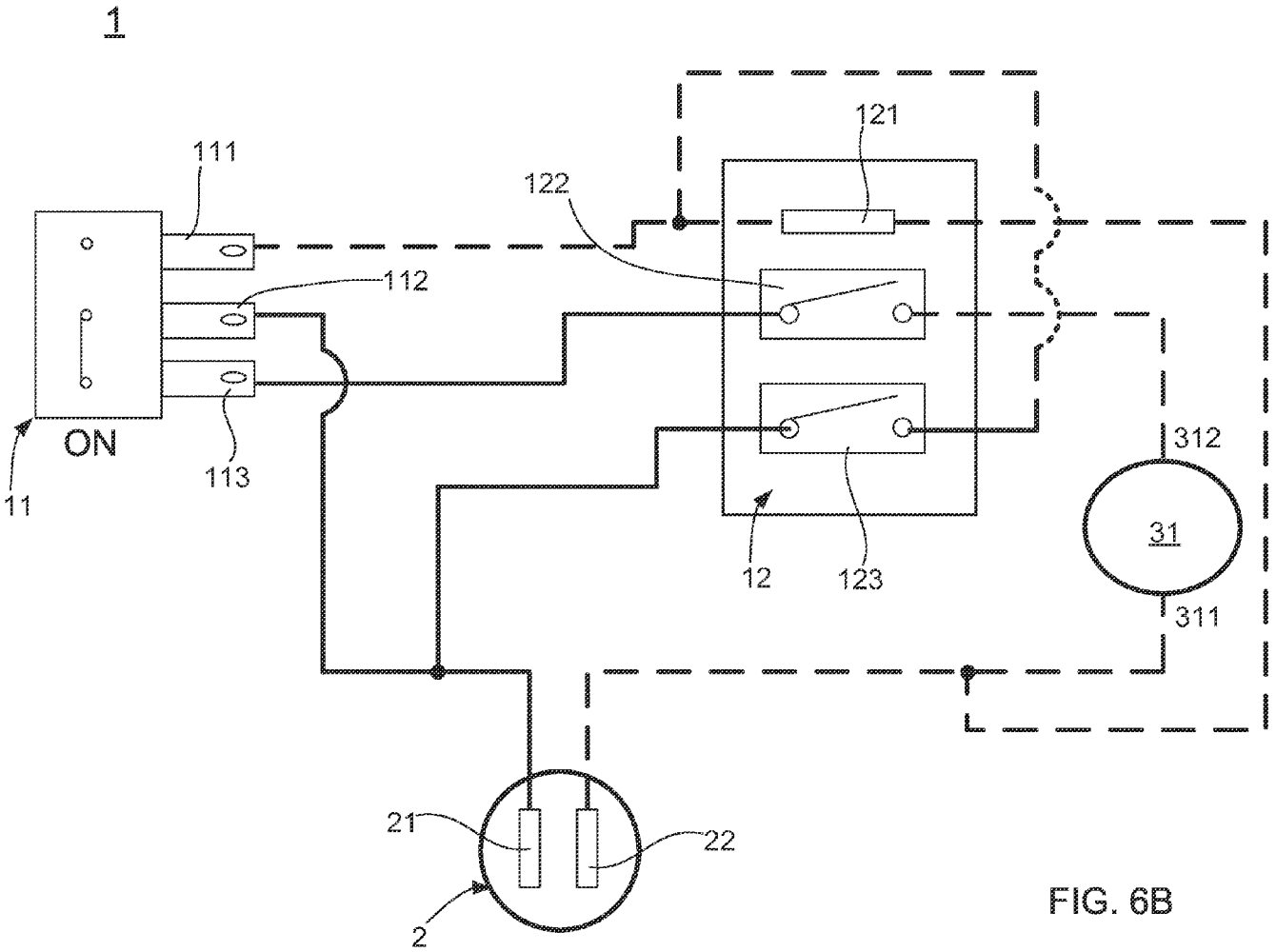

Next, a flow chart of a restart protection method shown as FIG. 5 and related circuit action diagrams of the restart protection device 1 shown as FIGS. 6A-6D are used for detailedly introducing the technology features of the restart protection device 1 of the present invention. As shown in FIG. 5, when a user operates an electric device 3 installed with the restart protection deice 1, the user must follow the steps of:

Firstly, because the switch module 11 is in an OFF state, as shown by the dashed line drawn in FIG. 6A, there has no any current flows in the circuit of the restart protection device 1. So that, in step (S01), the user needs to switch on the switch module 11 for making the electrical power terminal 112 of the switch module 11 electrically connect to the line terminal 21 of the external electrical power 2. Therefore, as shown by the solid line drawn in FIG. 6B, the current outputted by the line terminal 21 of the external electrical power 2 would flow toward the first relay switch 122 of the restart protecting module 12 via the second output terminal 113 of the switch module 11, and then be blocked off by the first relay switch 122. Thus, because the current outputted by the line terminal 21 of the electrical power 2 is blocked off by the first relay switch 122 of the restart protecting module 12, the current produced from restarting the electric device 3 would not directly input into the motor 31 of the electric device 3.

Figure 6C:
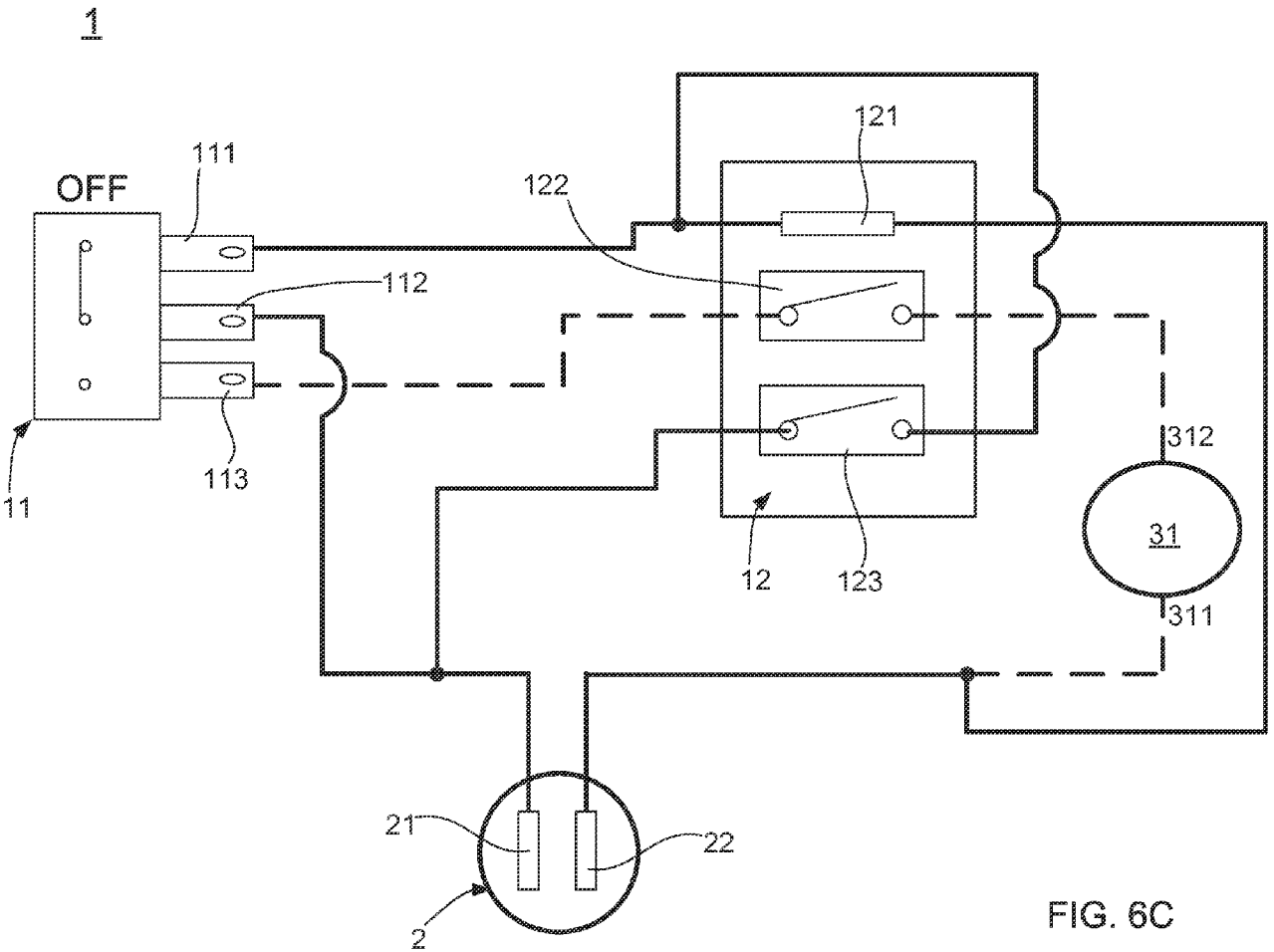

After the step (S01) is completed, the user needs to continuously executes step (S02) for switching off the switch module 11, so as to make the electrical power terminal 112 of the switch module 11 electrically connect to the first output terminal 111. Therefore, as shown by the solid line drawn in FIG. 6C, the current outputted by the line terminal 21 of the electrical power 2 would flow into the relay coil 121 of the restart protecting module 12 via the electrical power terminal 111, and the first relay switch 122 and the second relay switch 123 are turned on by the induction of the relay coil 121. In which, the current path constructed by the solid line drawn in FIG. 6C is a first output loop formed in the circuit of restart protection device 1, and the current outputted by the live terminal 21 of the electrical power 2 does flow in the first output loop.

Figure 6D:
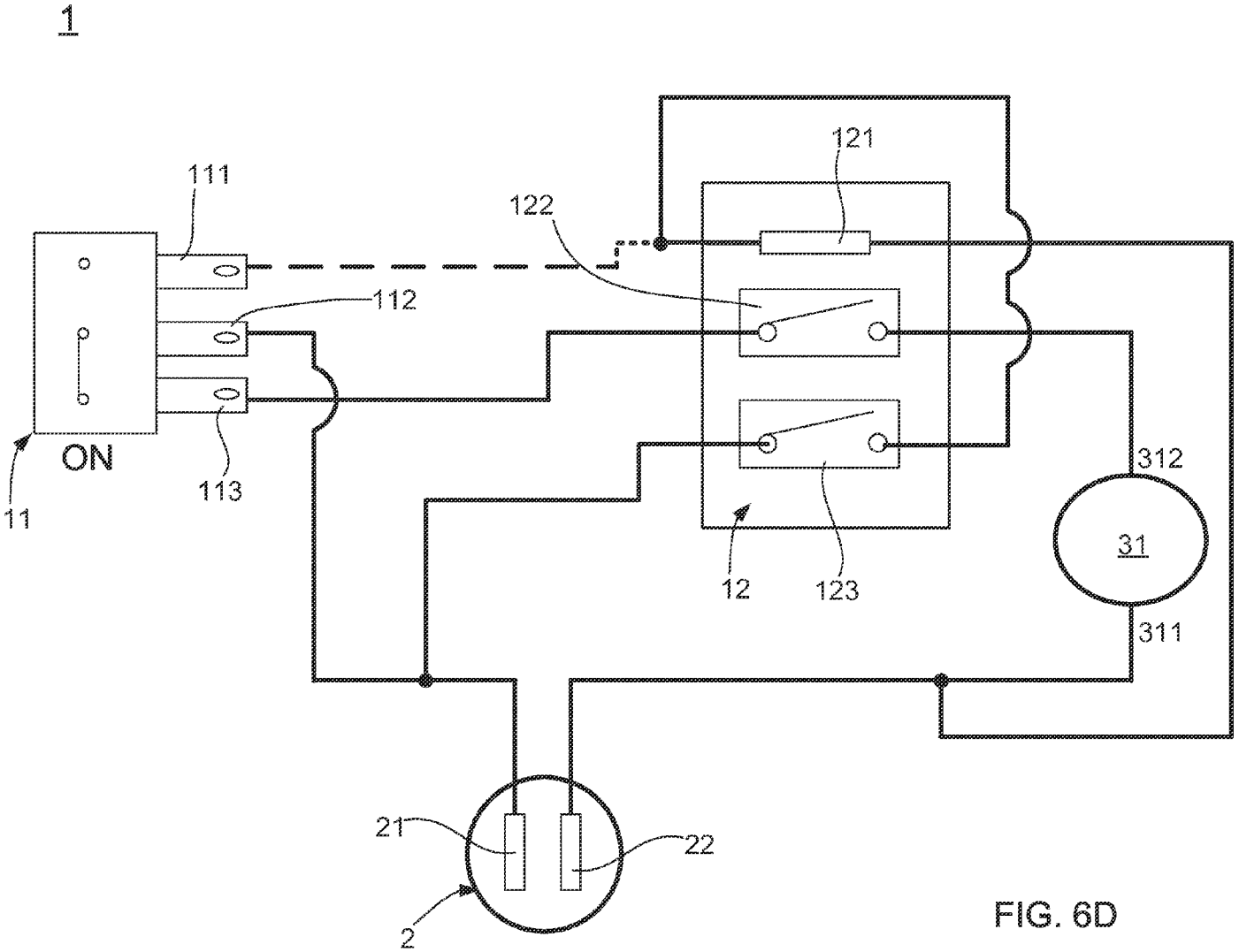

Eventually, the user needs to executes step (S03) for switching on the switch module 11, so as to make the electrical power terminal 112 electrically connect to the second output terminal 113. Therefore, as shown by the solid line drawn in FIG. 6D, the current outputted by the live terminal 21 of the electrical power 2 would flow into the second input terminal 312 (i.e., the live terminal of the motor 31) of the motor 31 in the electric device 3 through the second output terminal 113 of the switch module 11 and the first relay switch 122 of the restart protecting module 12, moreover the current outputted by the live terminal 21 of the electrical power 2 would also flow into the first input terminal 311 (i.e., the neutral terminal of the motor 31) of the motor 31 through the second relay switch 123 and the relay coil 121 of the restart protecting module 12, and then the motor 31 is drive to operate by the current. In which, the current path constructed by the solid line drawn in FIG. 6D is a second output loop formed in the circuit of restart protection device 1, and the current outputted by the live terminal 21 of the electrical power 2 does flow in the second output loop. Thus, by using the restart protection device 1 shown as FIG. 4 and the restart protection method shown as FIG. 5, it is able to prevent the accidents resulted from the following un-normal operations of the electric device 3:

Un-Normal Operation (1)

The user connects the electrical cable of the electric device 3 to the external electrical power 2, without switching off the switch module 11 of the electric device 3 in advance; meanwhile, the current produced from restarting the electric device 3 would be blocked off by the restart protecting module 12 of the restart protection device 1 installed in the electric device 3, therefore the current would not directly input into the motor 31 of the electric device 3, such that the motor 31 would not operate due to the sudden restart of the electric device 3.

Un-Normal Operation (2)

The electrical power 2 is suddenly tripped off and then be immediately recovered under the electric device is used by the user; in the meantime, the current produced from restarting the electric device 3 would be blocked off by the restart protecting module 12 of the restart protection device 1 installed in the electric device 3, therefore the current would not directly input into the motor 31 of the electric device 3, such that the motor 31 would not operate due to the sudden restart of the electric device 3.

Because the restart protection device 1 of the present invention would block the current from flowing into the motor 31 of the electric device 3, the user must follow the steps of the restart protection method in order to start the electric device 3. By such way, the unexpected accidents resulted from the sudden restart of the electric device can be effectively prevented.

Herein, it needs to emphasize that, the circuit framework illustrate in FIG. 3 and FIG. 4 does not used for limiting the exemplary embodiment of the restart protection device 1. Please refer to FIG. 7, which illustrates a second circuit framework diagram of the restart protection device 1., as shown in FIG. 7, the electrical power terminal 112 and the second output terminal 113 of the switch module 11 constitute a monopole switch unit; moreover, the first terminal 111 of the switch module 11 is coupled to the electrical power terminal 112 for being as a switch off sensing member.

Figure 7:
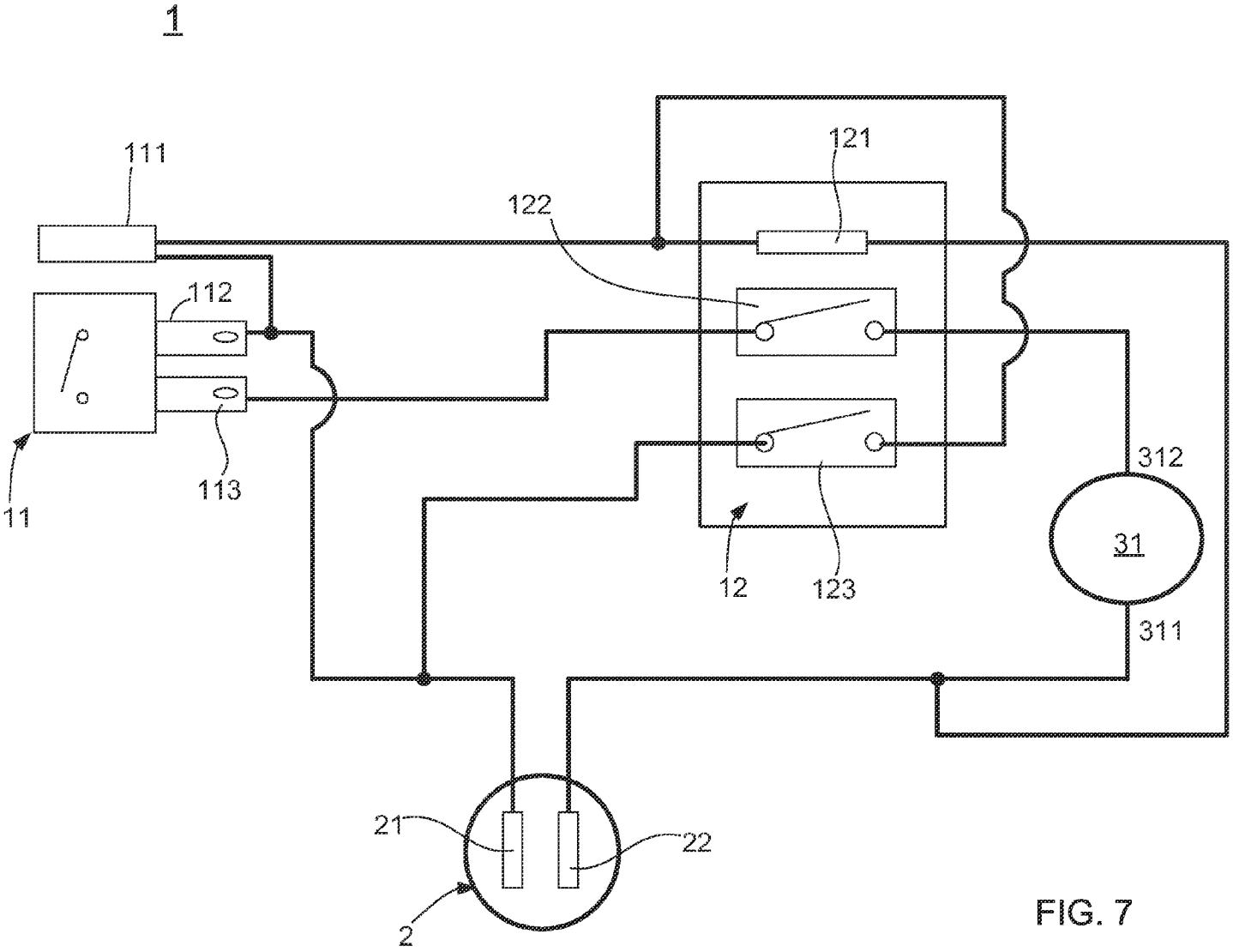
FIG. 7 is a second circuit framework diagram of the restart protection device.

Moreover, although the circuit framework drawn in FIG. 4 and FIG. 7 can be constituted by some pure electronic elements, it has to extra add some current and signal conversion circuits into the restart protection device 1 due to the electric deice 3 is a mechanical device when using the pure electronic elements to constitute the restart protection device 1. Besides, comparing to the restart protection device constituted by the pure electronic elements, the restart protection device 1 drawn in FIG. 4 and FIG. 7 includes the advantages of high stability and low cost.

The above description is made on embodiments of the present invention. However, the embodiments are not intended to limit scope of the present invention, and all equivalent implementations or alterations within the spirit of the present invention still fall within the scope of the present invention.

What is claimed is:

1. A restart protection device, comprising:

a switch module, being disposed in an electric device and coupled to an external electrical power, wherein the switch module has an electrical power terminal, a first output terminal and a second output terminal, and the electrical power terminal being connected to a line terminal of the electrical power; and a restart protecting module, being disposed in the electric device and coupled to the switch module and a motor of the electric device, wherein the restart protecting module comprises:

a relay coil, being coupled to the first output terminal by one end thereof, and the other end of the relay coil being coupled to a first input terminal of the motor;

a first relay switch, being coupled to the second output terminal by one end thereof, and the other end of the first relay coil being coupled to a second input terminal of the motor; and a second relay switch, being coupled to the line terminal and the electrical power terminal by one end thereof, and the other end of the second relay switch being coupled to the first output terminal and the relay coil;

wherein the first input end of the motor is further coupled to a neutral terminal of the electrical power.

2. The restart protection device of claim 1, wherein the electric device is selected from the group consisting of: metal cutting power tool, polish power tool, assembly power tool, pneumatic gun, and hair dryer.

3. The restart protection device of claim 2, wherein the aforesaid assembly power tool is selected from the group consisting of: electric drill, electric wrench and electric screw driver.

4. The restart protection device of claim 1, wherein the switch module is selected from the group consisting of: rocker switch, slide switch and toggle switch.

5. The restart protection device of claim 1, wherein the electrical power terminal and the second output terminal of the switch module constitute a monopole switch unit; moreover, the first terminal of the switch module being coupled to the electrical power terminal for being as a switch off sensing member.

6. The restart protection device of claim 1, wherein the second input terminal of the motor is a live terminal of motor, and the first input terminal of the motor is a neutral terminal of motor.

7. A restart protection method by using the aforesaid restart protection device of claim 1, comprising steps of:

(1) switching on the switch module, so as to make the electrical power terminal of the switch module electrically connect to the line terminal of the external electrical power; such that the current outputted by the line terminal of the external electrical power flows toward the first relay switch of the restart protecting module via the second output terminal of the switch module, and then be blocked off by the first relay switch;

(2) switching off the switch module, so as to make the electrical power terminal of the switch module electrically connect to the first output terminal; such that the current outputted by the line terminal of the electrical power flows into the relay coil of the restart protecting module via the electrical power terminal, and the first relay switch and the second relay switch being turned on by the induction of the relay coil; and (3) switching on the switch module, so as to make the electrical power terminal electrically connect to the second output terminal; such that the current outputted by the live terminal of the electrical power flows into the second input terminal of the motor in the electric device through the second output terminal of the switch module and the first relay switch of the restart protecting module, moreover the current outputted by the live terminal of the electrical power 2 also flows into the first input terminal of the motor through the second relay switch and the relay coil of the restart protecting module, and then the motor is drive to operate by the current.

8. The restart protection method of claim 7, wherein the restart protection device is formed within a first output loop in the step (2), and the current outputted by the live terminal of the electrical power does flow in the first output loop.

9. The restart protection method of claim 7, wherein the restart protection device is formed within a second output loop in the step (3), and the current outputted by the live terminal of the electrical power does flow in the second output loop.

* * * * *